US005317972A

United States Patent [19]

Honkawa et al.

[11] Patent Number: 5,317,972

[45] Date of Patent: Jun. 7, 1994

[54] OFFSET PRINTING MACHINE, PRINTING PLATE AND IMAGE POSITION READING-OUT METHOD FOR OFFSET PRINTING MACHINE

[75] Inventors: Yoshinori Honkawa; Kenso Maehara, both of Fuchu, Japan

[73] Assignee: Ryobi Limited, Tokyo, Japan

[21] Appl. No.: 947,158

[22] Filed: Sep. 18, 1992

Related U.S. Application Data

[62] Division of Ser. No. 817,791, Dec. 27, 1991, Pat. No. 5,167,186.

[30] Foreign Application Priority Data

Dec. 28, 1990 [JP] Japan ..... 2-417184
Jun. 17, 1991 [JP] Japan ..... 3-144929

[51] Int. Cl.[5] ..... B41F 27/06; B41F 27/12; B41L 29/12; B41L 35/08

[52] U.S. Cl. ..... 101/486; 101/415.1

[58] Field of Search ..... 101/485, 486, 481, DIG. 36, 101/415.1, 375, 477, 378, 401.1

[56] References Cited

U.S. PATENT DOCUMENTS 3,691,950 9/1972 Gates ..... 101/415.1
4,485,447 11/1984 Ericsson ..... 364/469
4,489,652 12/1984 Takeuchi et al. ..... 101/211
4,840,121 6/1989 Szczesniak ..... 101/217
5,117,365 5/1992 Jeschke et al. ..... 101/DIG. 36

*Primary Examiner*—J. Reed Fisher
*Attorney, Agent, or Firm*—Brooks & Kushman

[57] ABSTRACT

A printing machine is disclosed in which a sleeve having a tapered side surface is provided movably in an axial direction to a gripper shaft 5 arranged in parallel to a plate cylinder shaft 2. A sleeve member 25 is provided movably in the axial direction of the plate cylinder shaft 2. The sleeve member 25 is connected to the sleeve by a swingable arm. A screw 18 which is brought into contact with the tapered side surface of the sleeve is fixed to a bracket 16 mounted on the gripper shaft 5. Furthermore, a plate 13, a gripper 10 and a front abutment are provided on the gripper shaft 5, the front abutment being moved. An amount of displacement of an image position on the printing plate relative to a regular or normal position is obtained by intersecting two lines 47*b* and 47*c* formed at the clamp end portion. Since the method is related to a method of drawing two lines 47*b* and 47*c* having any width, it is possible to eliminate an error generated due to a configuration error of a register mark and it is possible to detect the image position width high precision. Accordingly, when the printing plate is automatically fed to the plate cylinder of an offset printing machine, it is possible to feed the printing plate with the image on the printing plate being parallel to the plate cylinder.

7 Claims, 12 Drawing Sheets

OFFSET PRINTING MACHINE, PRINTING PLATE AND IMAGE POSITION READING-OUT METHOD FOR OFFSET PRINTING MACHINE

This is a division of copending application Ser. No. 07/817,791, filed on Dec. 27, 1991, now U.S. Pat. No. 5,167,186.

BACKGROUND OF THE INVENTION

The present invention relates to an offset printing machine or press, and more particularly to an offset printing machine provided with a clamp adjusting member for mounting a printing plate onto a plate cylinder. The invention relates to a printing plate wherein lines for detecting a displacement or offset of an image position relative to a regular or an exact position are formed. It is also concerned with an image position reading-out method for detecting a displacement or an offset of an image position of a printing plate.

In general, in the printing work, it is necessary to print the images in parallel to the printing paper. It is therefore necessary to position the images of the printing plate relative to the plate cylinder. However, it would be very difficult to position the images parallel to a clamping portion of the printing plate. The images would often be slanted to the clamp portion of the printing plate. Also, a distance from the clamp portion would be changed in every print. There would be no image in a center of the printing plate. There would be a fear that a printed article would be obtained with the images being twisted to the clamp portion of the printing plate during the printing operation. Accordingly, in the case where after a few pieces of prints or printed article have been obtained in the initial stage of the printing operation, the images are twisted, the printing plate must be once peeled off and again clamped in place. Such operation will be referred to as "reclamping".

Accordingly, various methods have been proposed to dispense with the reclamping operation.

There is a first method for laying an original on an original table of a printing machine, which utilizes a pin system during the printing operation, and prints the images in parallel to or perpendicular to a marginal portion of the printing plate.

There is a second method for cutting the clamp portion of the printing plate for every printing in parallel to the images after the printing operation has been effected.

A third method is that a twist of the slanted image is adjusted by moving a table by a knob (Japanese Utility Model Publication No. 58-4670 and Japanese Utility Model Laid-Open Publication No. 60-127929).

A fourth method is that a twist adjustment mechanism is provided within a plate cylinder shaft supported on the plate cylinder, a bracket is moved along the plate cylinder shaft, and a position of a clamp claw is adjusted (see Japanese Patent Laid-Open Application No. 61-125847). In this method, a rotation of the plate cylinder shaft is adjusted step by step through the engagement between a claw and a ratchet wheel. In this case, a register mark having a special shape is printed together with the image; the register mark is read out; a displacement in distance of the image at the clamp portion (vertical direction), a displacement of the image relative to the center of the print and an amount of slant of the image are calculated; and finally, the position of the print relative to the plate cylinder is corrected on the basis of these data.

There is a fifth method in which a displacement of the position of the image is detected by effecting a register mark on the print and the displacement is corrected as shown in Japanese patent Laid-Open Publication No. 59-123665.

Although the "reclamping" operation of peeling the print once mounted on the plate cylinder and again clamping the print might be dispensed with in accordance with the first through third methods, any of these methods suffers from a difficulty such that the operation needs a long period of time.

Turning to the fourth and fifth methods, since special marks such as a register mark B in the fourth method (Japanese Patent Laid-Open Publication No. 61-125847) and horizontal and oblique register marks in the fifth method (Japanese Patent Laid-Open Publication No. 59-123665) are used, an error due to a shape of the mark shape itself would become an actual error in measuring a displacement amount, i.e., a movement amount. In addition, it is necessary to provide a special jig and an special apparatus for producing a special register mark.

Also, in the fourth method (Japanese Patent Laid-Open Publication No. 61-125847), since only distances $I_1$ and $I_2$ from a predetermined reference position x—x to the register marks B and C are read out, if lines of the register marks B and C would be thin during the printing operation, this would be an error of the displacement amount, i.e., movement amount. In addition, since the reading-out method is based upon the distances $I_1$ and $I_2$ from the reference position, if the setting of the print would be improper, this would be an error. Moreover, in the fourth method, since the rotation of the plate cylinder is stepwise adjusted, if would be impossible to finely adjust the rotation.

SUMMARY OF THE INVENTION

Accordingly, in order to overcome the above-noted defects inherent in the prior art, a primary object of the present invention is to provide an offset printing machine in which a position of a printing plate is exactly measured and the printing plate is mounted on the plate cylinder with an extremely simple operation and with high precision so that an image printed on the printing plate with a twist is in parallel to a plate cylinder shaft.

According to one aspect of the present invention, there is provided an offset printing machine including an automatically printing plate feeding device for automatically feeding a printing plate to a plate cylinder, a clamp means for clamping the printing plate, fed by said automatically printing plate feeding device, onto said plate cylinder, and a plate cylinder shaft provided in said plate cylinder, said clamping means being swingable relative to a base side line of said plate cylinder, said printing machine comprising: a moving member provided on said plate cylinder shaft, said moving member being drivingly movable in an axial direction of said plate cylinder shaft; and a clamp adjusting member for performing positional adjustment of said clamping means; wherein said moving member is driven in response to a twist relative to said printing plate to thereby perform the positional adjustment of said clamp adjusting member.

According to the present invention, the machine further comprises an arithmetic means for calculating the twist of the image relative to the printing plate; and a drive means for moving the moving member in accordance with a result of the calculation of the arithmetic means.

According to another aspect of the present invention, there is provided a printing plate comprising a first line drawn in parallel with an outline for indicating an image region on an image surface on a clamp side of said printing plate, and a second line drawn perpendicular to said first line while passing through a center of said image region on the image surface.

According to still another aspect of the present invention, there is provided a method for reading out an image position of an offset printing machine, comprising the steps of: printing a first line drawn in parallel with an outline for indicating an image region on an image surface on a clamp side of a printing plate and a second line drawn perpendicular to said first line while passing through a center of said image region on the image surface; reading the first and second lines and opposite lateral edges of the printing plate; and calculating an amount of displacement of the image position relative to a predetermined position on the basis of a relationship between the lateral edges of said printing plate and the respective lines.

DESCRIPTION OF THE PREFERRED EMBODIMENTS

The present invention will now be described with reference to the accompanying drawings.

Figure 1:
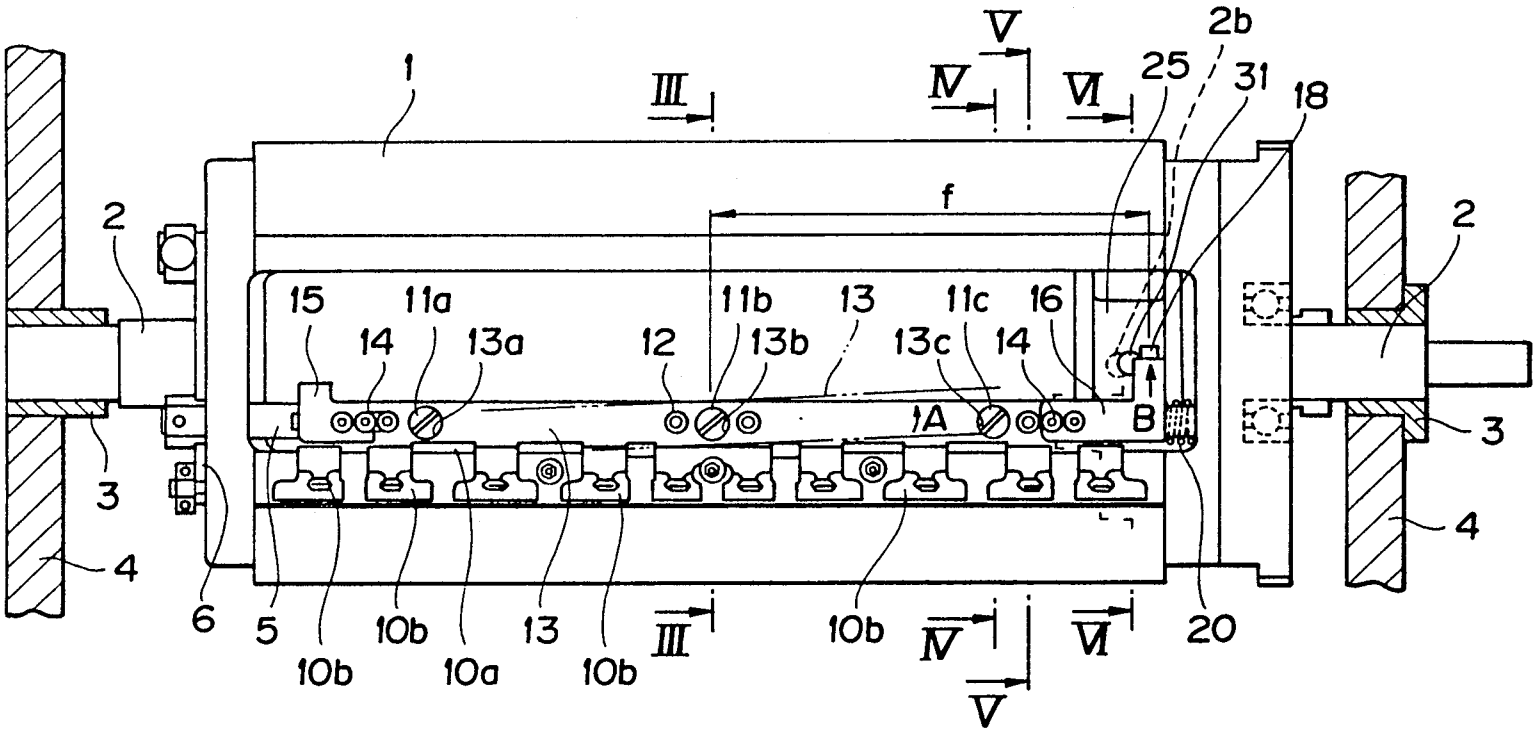
FIG. 1 is a front view showing a plate cylinder of an offset printing machine according to the invention.
Figure 2:
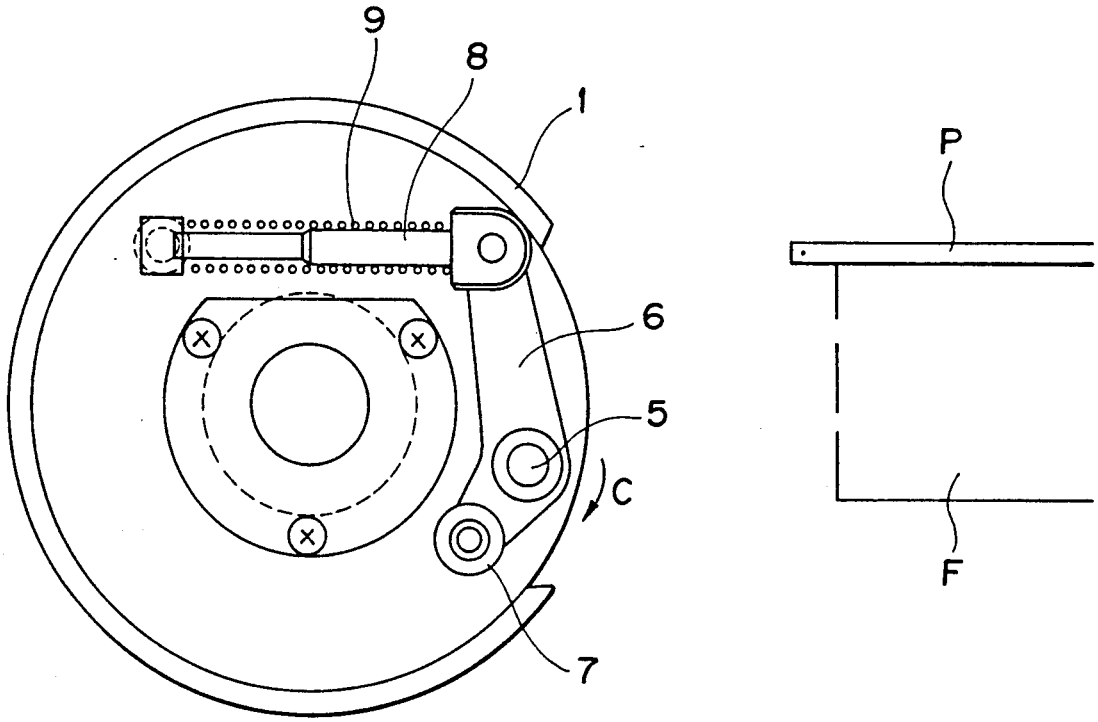
FIG. 2 is a side elevational view showing the plate cylinder shown in FIG. 1.

FIG. 1 is a front view showing a plate cylinder of an offset printing machine or press according to the present invention. The plate cylinder, generally designated by reference numeral 1, has a plate cylinder shaft 2 which is pivotally supported coaxially within a hollow interior of the plate cylinder 1 through bearings 3. The plate cylinder shaft 2 is supported on the frames 4, 4 so that the plate cylinder 1 is supported in place. A gripper shaft 5 is rotatably provided at a desired position of the plate cylinder 1. A swingable arm 6 is fixed to one end portion of the gripper shaft 5 for opening/closing a gripper as best shown in FIG. 2. A cam follower 7 which comes in contact with a drive cam (not shown) is rotatably mounted at one end portion of the swingable arm 6. A rod 8 which is pivotally connected at one end to the plate cylinder 1 is pivotally mounted at the other end of the swingable arm 6. The swingable arm 6 is normally biased in one direction by a spring 9 wound around the rod 8. A printing plate P is fed automatically to the plate cylinder 1 by a feeding device F as shown in FIG. 2.

A proximal end portion **10*a* of the gripper 10 is fixed to the gripper shaft 5 by three pins 11*a*, 11*b* and 11*c* and a bolt 12 (FIG. 1). The gripper 10 is formed so that a plurality of gripper portions 10*b*, 10*b*, . . . are projected from the elongated proximal end portion 10*a*. A plate 13 is swingably mounted on the gripper shaft 5 by the above-described three pins 11*a*, 11*b* and 11*c*. It should be noted that holes 13*a*, 13*b* and 13*c* are formed for insertion of the pins into the plate 13 so that the central hole 13*b* is larger in diameter than the pin 11*b* by about 0.05 mm and the end side holes 13*a* and 13*c* are larger in diameter than the pins 11*a* and 11*c* by about 1 mm. As a result, the plate 13 is swingable so as to be slanted relative to a base line of the plate cylinder 1. Brackets 15 and 16 and front abutments 17, 17 (FIGS. 3 to 6) are fixed in the vicinity of both ends of the plate 13 by screws 14, 14. The front abutments 17 are used for positioning the printing plate when the printing plate is to be mounted onto the plate cylinder 1. An adjusting screw 18 is provided, as an abutment member for abutting against a first sleeve member 19 mentioned below, in the right side bracket 16 (FIG. 1), and the screw 18 is biased to a tapered side surface of the first sleeve 19, which is slidably mounted on the gripper shaft 5, by a spring (not shown) provided to the bracket 15 (see FIGS. 3 and 7). The sleeve 19 is normally biased to the left (in FIG. 1) by a spring 20. The adjusting screw 18 is projected adjustably toward the sleeve 19**.

Figure 3:
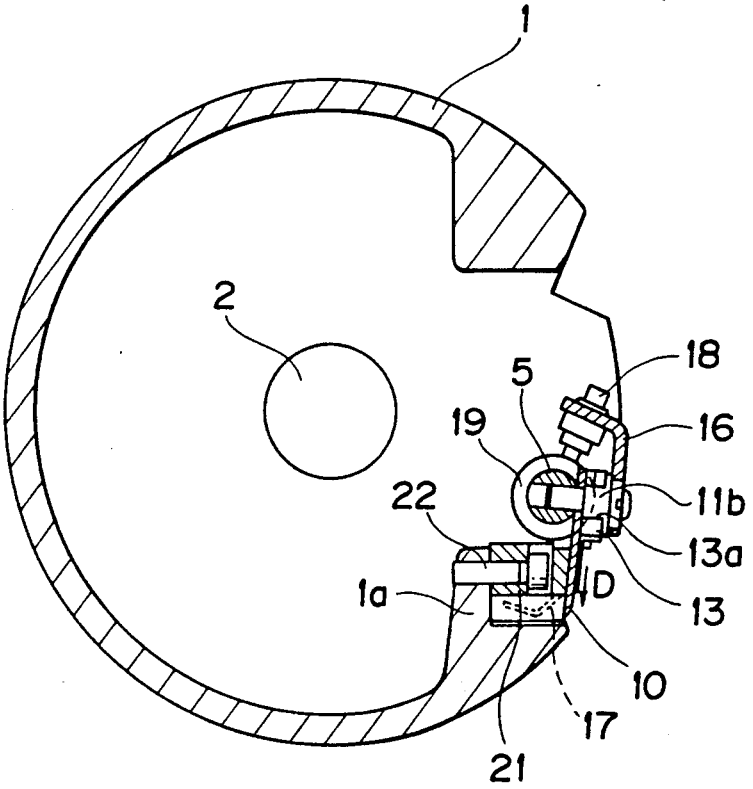
FIG. 3 is a cross-sectional view taken along the line III—III of FIG. 1.
Figure 4:
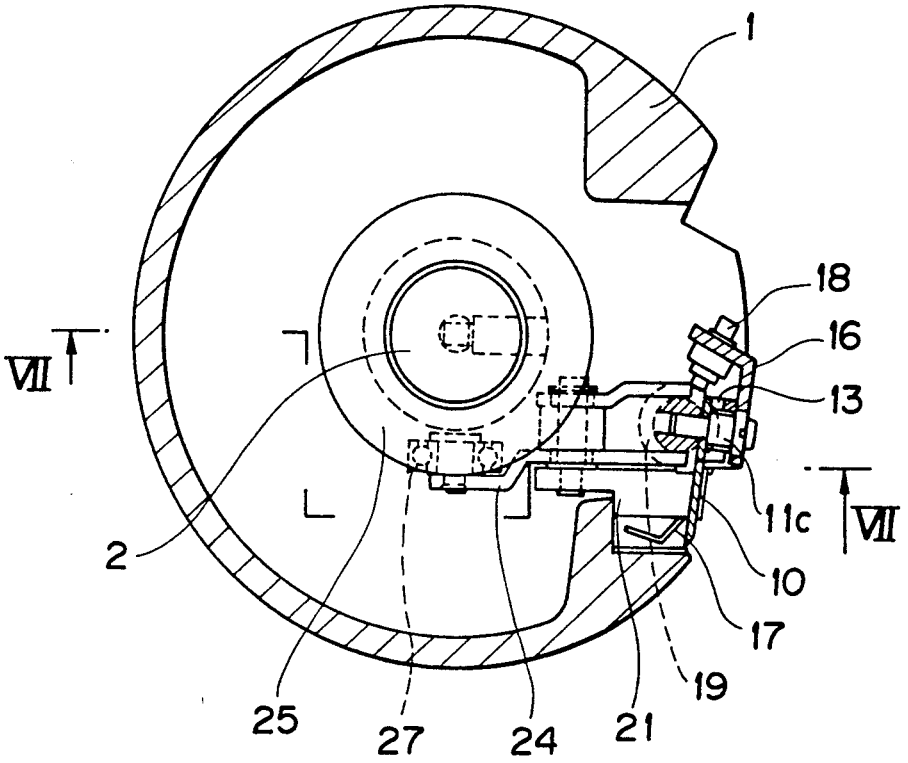
FIG. 4 is a cross-sectional view taken along the line IV—IV of FIG. 1.
Figure 5:
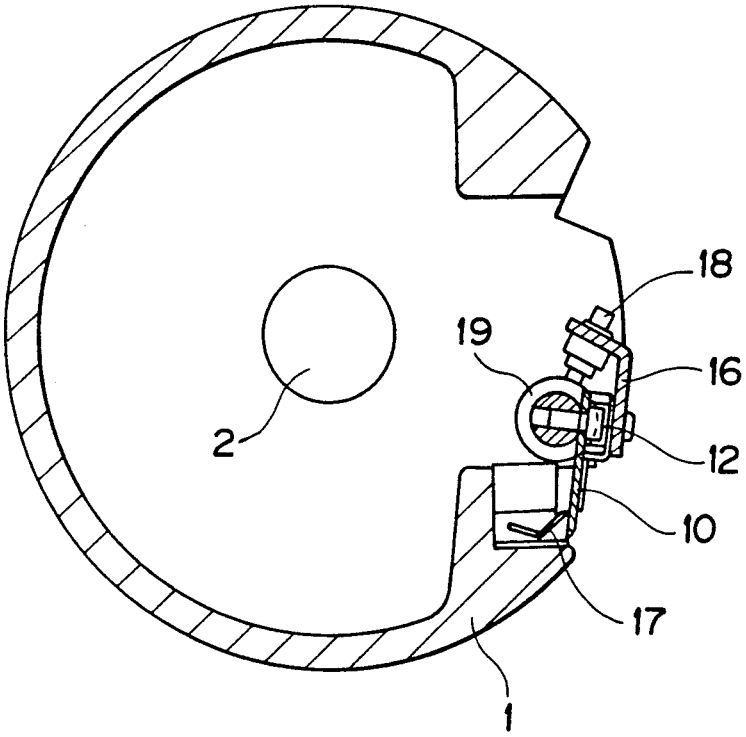
FIG. 5 is a cross-sectional view taken along the line V—V of FIG. 1.
Figure 6:
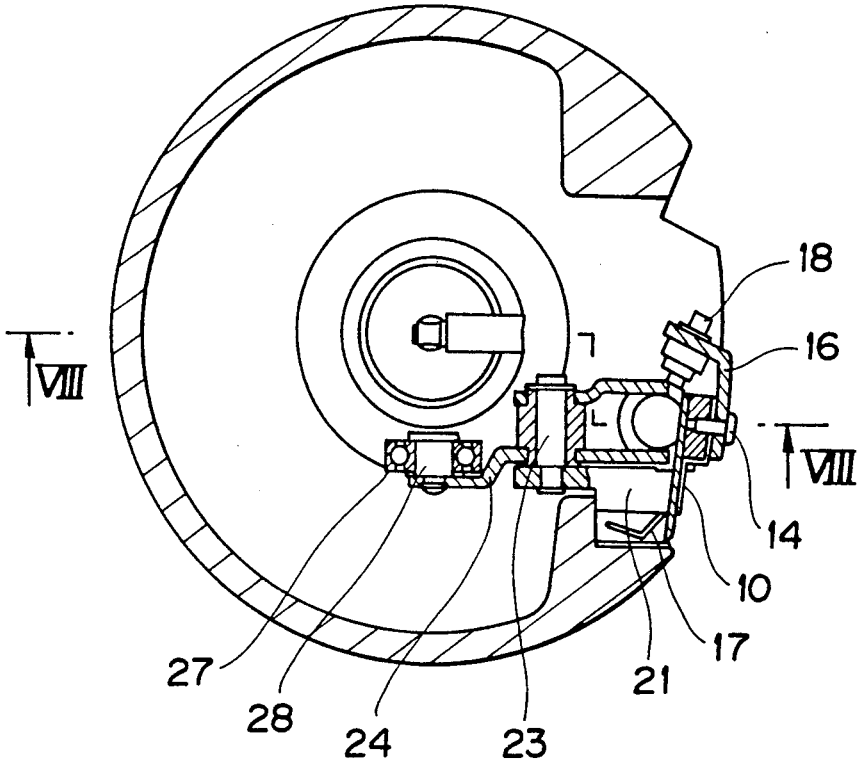
FIG. 6 is a cross-sectional view taken along the line VI—VI of FIG. 1.

On the other hand, as shown in FIG. 3, a gripper base 21 is fixed to a flanged portion **1*a* of the plate cylinder 1 by a bolt 22. As shown in FIG. 6, a swing arm 24 which is provided to the gripper base 21 through a pin 23**.

Figure 7:
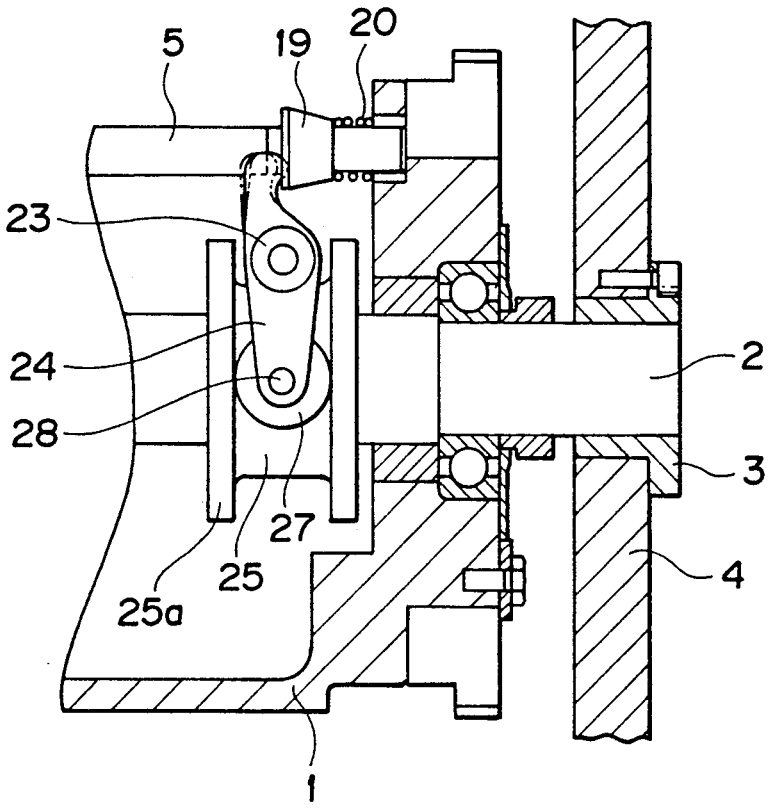
FIG. 7 is a cross-sectional view taken along the line VII—VII of FIG. 4.
Figure 8:
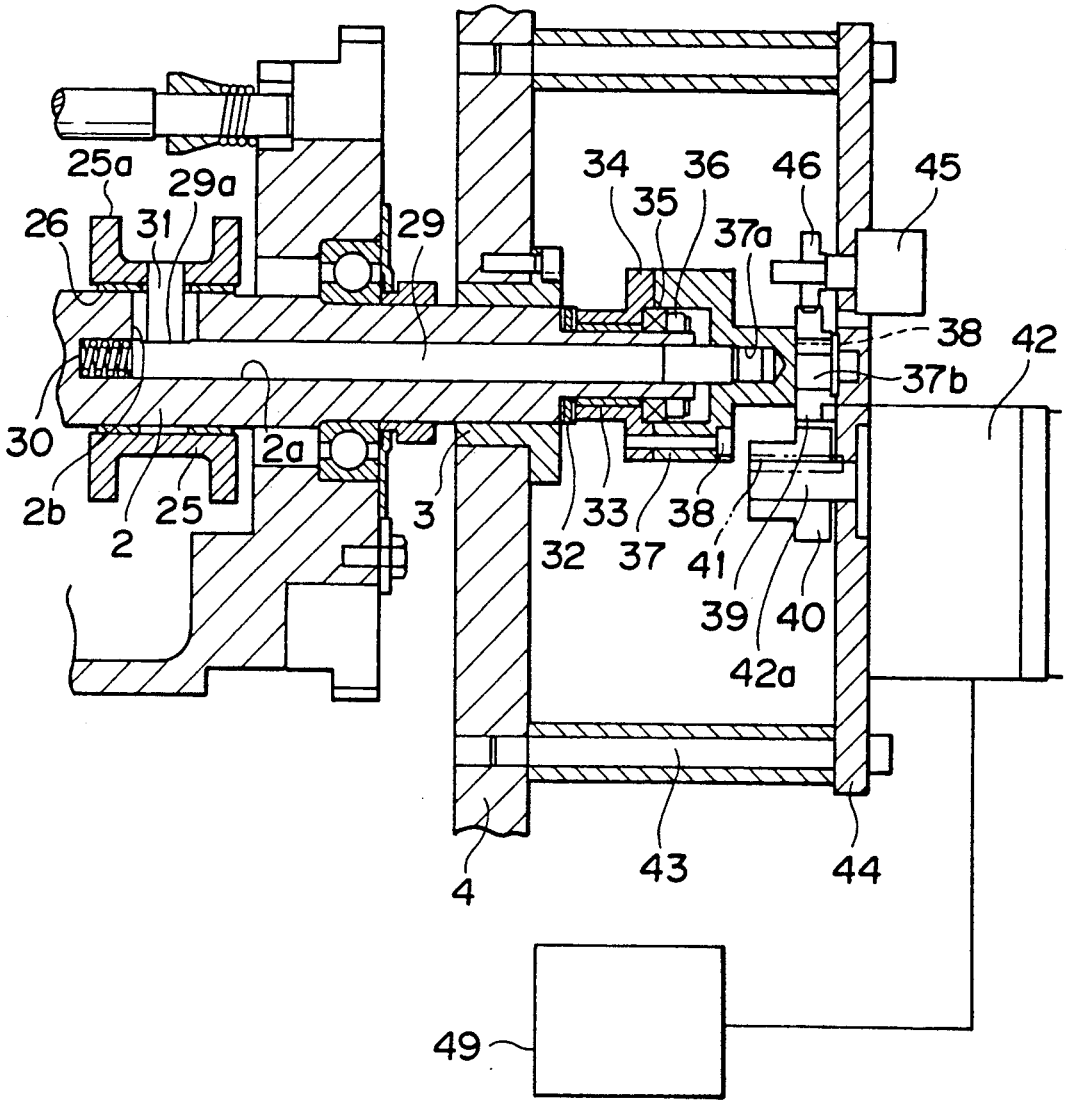
FIG. 8 is a cross-sectional view taken along the line VIII—VIII of FIG. 6.

A second sleeve member 25 which is used as a moving member is provided movably in the axial direction through a bush 26 to the plate cylinder shaft 2 (FIGS. 7 and 8). A bearing 27 supported by a pin 28 is provided at one end portion of the swing arm 24. The bearing 27 is provided so as to come into contact with a flange portion **25*a* of the second sleeve member 25 by the axial movement of the sleeve member 25. The other end portion of the swing arm 24 is brought into contact with the above-described sleeve 19**.

On the other hand, as shown in FIG. 8, in the right end portion of the plate cylinder 2, there is formed a hole **2*a* extending in the axial direction. A screw shaft 29 which is used as a part of driving mechanism for driving the second sleeve member 25 is inserted into the hole 2*a*. The screw shaft 29 is normally biased rightward (in FIG. 8) by a spring 30 interposed within an inner portion of the hole 2*a*. The screw shaft 29 has a threaded portion at its tip end portion with a groove 29*a* at a desired position. An elongated hole 2*b* is formed in a desired position of the plate cylinder shaft 2 corresponding to the groove 29*a*. A pin 31 formed on the sleeve member 25 passes through the elongated hole 2*b* and comes into contact with a bottom of the groove 29*a***.

A first coupling 34 is inserted through a bearing 32 and a spacer 33 into a tip end portion of the plate cylinder shaft 2. A nut 36 is threadedly engaged with the plate cylinder shaft 2 through a bearing 35 at the inner right end portion of the first coupling 34. A second coupling 37 is fixed by a bolt 38 to the right end portion (FIG. 8) of the first coupling 34. The screw portion of the screw shaft 29 is threadedly engaged with a screw hole 37*a* formed in the second coupling 37. A driven gear 39 is fixed through a key 38 to a shaft portion 37*b* of the right end portion (FIG. 8) of the second coupling 37. The driven gear 39 meshes with a drive gear 40 which is in turn fixed to a drive shaft 42*a* of a drive motor 42 through a key 41. The motor 42 is fixed to a frame 44 provided through studs 43 to the frame 4. A gear 46 connected to a potentiometer 45 meshes with the driven gear 39 so that the rotation of the driven gear 39 is restricted. The potentiometer 45 is fixed to the frame 44. A control unit 49 which is an arithmetic unit is connected to the motor 42.

The operation of mounting a printing plate onto a plate cylinder of an offset printing machine according to the invention will now be explained.

Figure 9A:
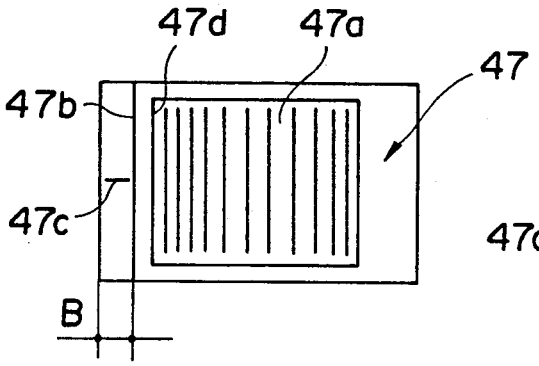
FIG. 9A to 9C are plan views of an original, a printing plate and an image reading device according to the invention.
Figure 9B:
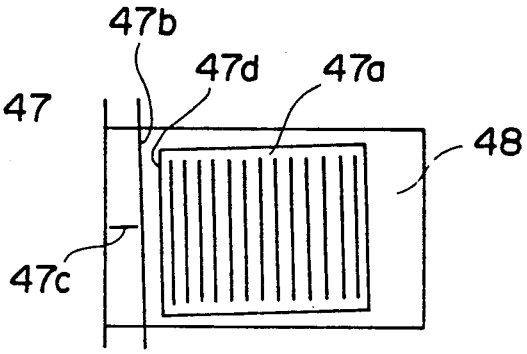

The effect of the printing will be first explained. FIG. 9A shows an original 47 to be printed. A first line 47*b* which is in parallel with an outline 47*d*, i.e., a line indicating an image region of an image portion 47*a* of the original 47 and a second line 47*c* which is perpendicular to the line 47*b* and passes through a center of the image portion 47*a* are located in one end portion of the original 47. Namely, the line 47*b* and 47*c* are included in a position corresponding to the clamp end portion on the printing plate P so as not to appear on the printed matter. At this time, the line 47*b* is in parallel with the clamp end of the original 47. The distance of the clamp end portion is represented by B. Under this condition, printing operation is effected to thereby obtain a printing plate 48 (FIG. 9B). In this case, there is a fear that the printing operation would be obtained with the image portion 47*a* being displaced from a regular or normal position. The printing plate 48 is introduced into the image reading-out apparatus. Then, assuming that c is a distance (width) between lateral edges 48*a* and 48*b* of the printing plate 48 and $i_1$ and $i_2$ are the points on the line 47*b* to be read out by line sensors 63 and 64 (to be described later), the distances a, b, c and d are optically read out where b is the distance between the clamp end edge 48*c* of the printing plate 48 and the point $i_1$, a is the distance between the clamp end edge 48*c* and the point $i_2$, and d is the distance between the edge 48*b* and the point $i_0$ which is a predetermined point on the line 47*c*. The line sensors 61, 62 . . . 64 are assembled together to form a line sensor unit which is stopped at a predetermined position separated from the edge of the printing plate 48 by a stopper provided on the line sensor unit. Incidentally, the distance between the points $i_1$ and $i_2$ are representative of values determined by the distance between the line sensor 63 and the line sensor 64. The displacements X (in the vertical direction (rotational direction of the plate cylinder)), Y (in the lateral direction) and Z (in the oblique (twist) direction) are calculated from the parameters a, b, c, d and e.

Figure 11:
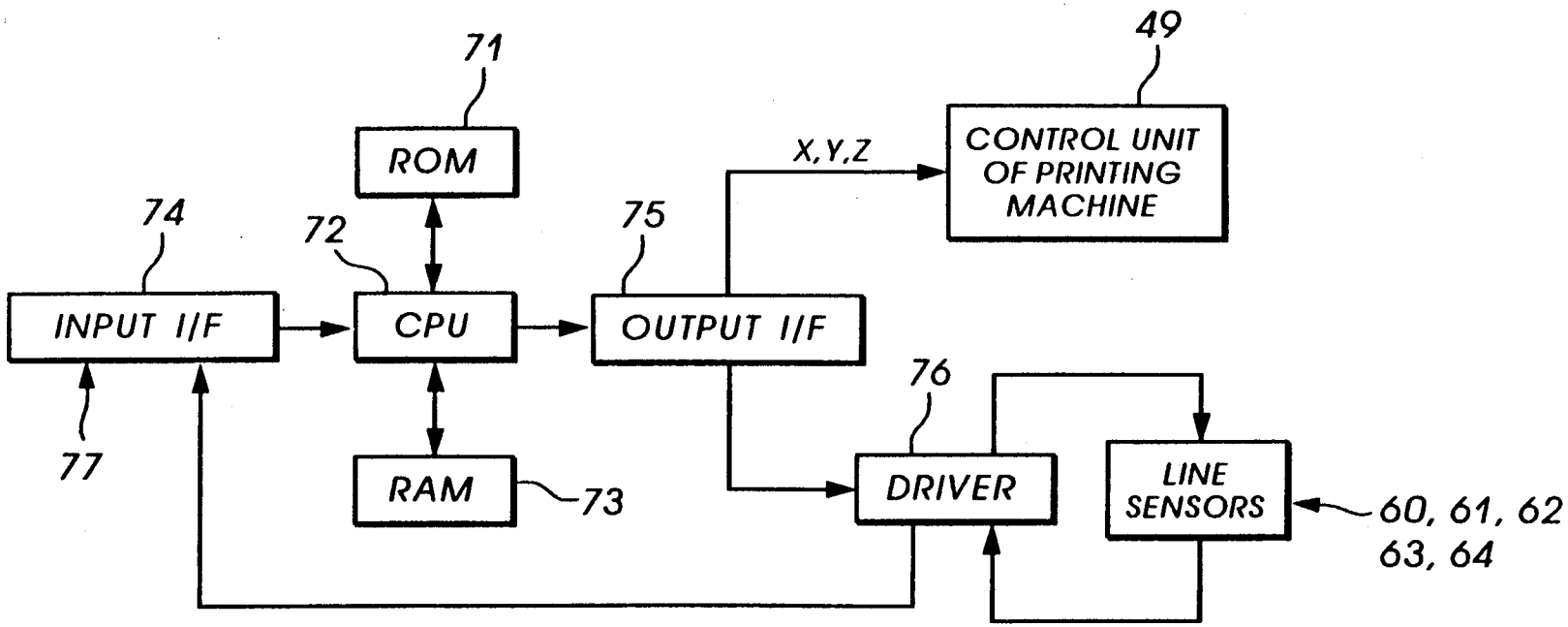
FIG. 11 is a block diagram showing an image position detecting apparatus.

An electronic mechanism of an image position detecting apparatus will be explained with reference to FIG. 11. The image position detecting apparatus is provided with a central processing unit CPU 72 which is in turn provided with ROM 71 and RAM 73 for storing data needed for processing of CPU 72. Also, line sensors 60, 61, 62, 63 and 64 are connected to CPU 72 through a driver 76 and an input interface I/F 74.

Data X, Y and Z read out through respective lines by CPU 72 are outputted to the control unit 49 of the printing machine through an output I/F 75.

Figure 9C:
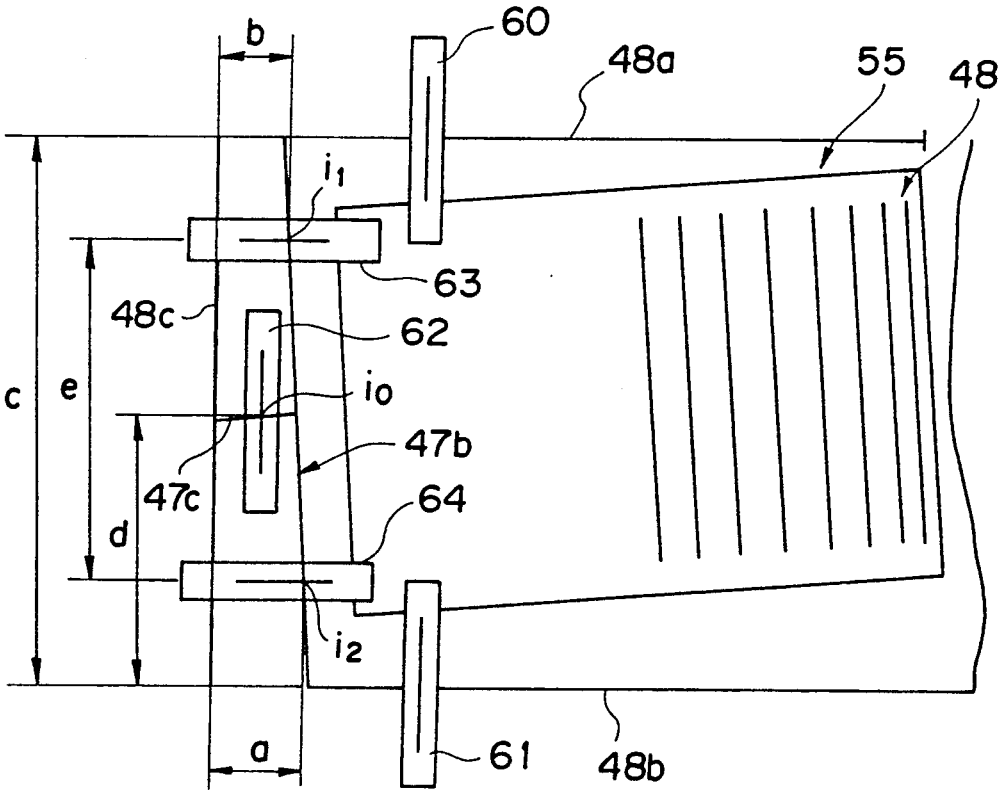

The first through fifth line sensors 60, 61, 62, 63 and 64 of the line reading devices are arranged as shown in FIG. 9C. More specifically, the first and second line sensors 60 and 61 are located to be intersected with the respective edges 48*a* and 48*b* so as to detect the edges 48*a* and 48*b* of the printing plate 48. The third line sensor 62 is laterally extended so as to detect the line 47*c*, whereas the fourth and fifth lines 63 and 64 are located in the vertical direction so as to detect the points $i_1$ and $i_2$.

The thus arranged image position detecting apparatus will be operated as follows. Drive signals are fed from CPU 72 through the output interface I/F to the driver 76 for driving the line sensors 60 to 64, so that the line sensors 60 to 64 are driven in accordance with the signals. The line sensors 60 and 61 may read out the opposite edges 48*a* and 48*b* so that the distance c is read out. The distance d is detected by the line sensors 61 and 62. The distance a is read out by the line sensor 64, and the distance b is detected by the line sensor 63. These values are inputted into the CPU 72 through the driver 76 and the input I/F 74. In CPU 72, the vertical displacement, i.e., an amount X of movement, the lateral displacement, i.e., an amount Y of movement, and an oblique (twist) displacement, i.e., an amount Z of movement are calculated. In the foregoing embodiment, the lines 47*b* and the line 47*c* are regarded as continuous lines. However, it is sufficient that the lines 47*b* and 47*c* are located only over the line sensors 62, 63 and 64 and may be dotted lines at portions other than the detection area.

The calculation method is as follows.

If the line is located at a distance B from the edge of the printing plate, the amount X of vertical movement is given by the following equation:

$$X=(a-b)/2-B$$

The amount Y of the lateral movement is given as follows:

$$Y=c/2-d$$

The amount Z of the oblique movement is given as follows:

$$Z=(a-b)c/e$$

In accordance with the above equations, the movements are calculated. The lateral movement amount is used to print the image to the center relative to the paper, and is adjusted by moving the plate cylinder 1 in the lateral direction by using a mechanism (not shown). The vertical movement amount is adjusted by rotating the plate cylinder 1 so as to be identical with a predetermined position. The thus set oblique amount and lateral amount are inputted into the control unit of the printing machine. When the oblique amount is inputted into the control unit 49, in the plate cylinder 1 in the embodiment shown in FIG. 1, assuming that f is the distance from the center of the pin 11*b* to the center of the screw 18, the control unit 49 is constructed so as to outputting a value by multiplying a predetermined set value f/c.

Accordingly, it is possible to apply the invention to the plate cylinder having any size by modifying the above-described set value.

Figure 10:
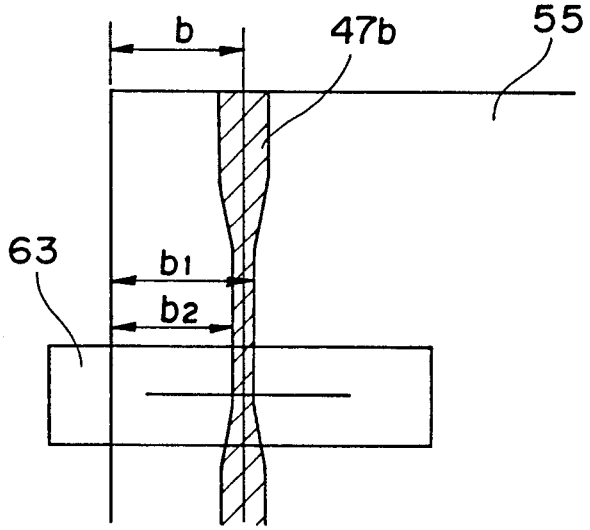
FIG. 10 is an illustration of a line readout.

On the other hand, the line printed on the print has a width, there would be an error depending upon the reading position of the lines 47*b* and 47*c*. If the line 47*b* (47*c*) is viewed on a large scale, as shown in FIG. 10, the width of the line is not kept constant and a thin part would be generated in the line during the printing operation.

According to the present invention, it is possible to read out the center of the line even by reading the opposite side edges of the line and calculating the center of the line as a line position in accordance with the following equation if any position of the line is read out.

$$b=(b_1+b_2)/2$$

This will be explained with reference to FIG. 10. Distances $b_1$ and $b_2$ of the edge portion of the line 47*b* are read out by the line sensor 63 to thereby calculate the distance b. According to this method, it is possible to detect the center of the line even if the line has any width. It is possible to readily involve the line in the printing plate.

In the same manner, the distances a and d are read out and the centerlines are calculated. The thus obtained values are used in the foregoing calculations and the respective amounts of movement are calculated.

If the oblique amount calculated by the control unit 49 is directed in a direction indicated by an arrow A in FIG. 1, the drive amount of the motor 42 in FIG. 8 is drivingly controlled. As a result, the drive gear 40 is rotated to thereby rotate the driven gear 39. Then the second coupling 37 and the first coupling 34 are rotated so that the screw shaft 29 threadedly engaged with the screw hole 37*a* of the second coupling 37 is moved in the axial direction since the rotational force of the screw shaft 29 is restricted by the groove 29*a* and the pin 31. In accordance with the axial movement of the screw shaft 29, one end portion of the swing arm 24 is swung in the clockwise direction in FIG. 7. As a result, the sleeve 19 that is brought into contact with the other end portion of the swing arm 24 is moved in the rightward direction (in FIG. 7) against the biasing force of the spring 20. By the movement of the sleeve 19, the screw 18 that is brought into contact with the tapered side surface of the sleeve 19 is continuously moved in a direction indicated by an arrow B in FIG. 1, the plate 13 is moved through the bracket 16 in the direction indicated by the arrow A. For this reason, the front abutment 17 fixed to the plate 13 is also moved. At this time, the movement of the front abutment 17 is a rotational motion around the pin 11*b*. Thus, it is possible to adjust the position of the front abutment 17.

Under this condition, the printing plate is delivered and the clamp end portion of the printing plate is inserted between the plate cylinder 1 and the gripper 10. When the printing plate is brought into contact with the front abutment 17, the delivery of the printing plate is stopped. Subsequently, the cam (not shown) is rotated, and the swingable arm 6 is rotated in a direction indicated by an arrow C through the cam follower. Thus, the gripper shaft 5 is rotated, and the gripper 10 fixed to the gripper shaft 5 is moved in a direction D indicated by an arrow D in FIG. 3 to thereby fix the printing plate onto the plate cylinder 2.

On the other hand, if the direction of the oblique amount is reversed, the motor 42 is rotated in the opposite direction to that described above so that the positional adjustment of the front abutment 17 may be performed in the same way.

In the foregoing embodiment, although the second coupling 37 is rotated by using the motor 42, it is not always necessary to used the motor 42. For instance, it is possible to manually rotate the second coupling 37 by mounting a lever thereon.

Figure 12:
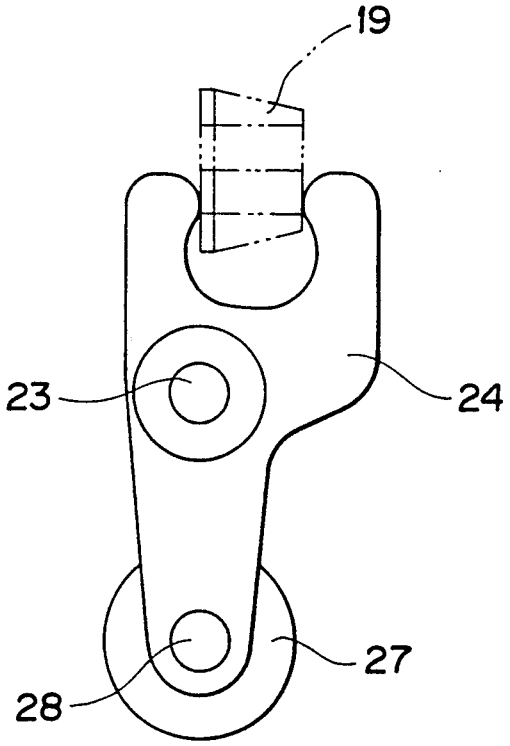
FIG. 12 is a front view showing a swing arm in accordance with another embodiment of the invention.

Also, if the structure of the swing arm 24 is modified so as to clamp the sleeve 19 as shown in FIG. 12, it is possible to dispense with the spring 20 to ensure the like effect and advantage. In addition, because the sleeve 19 has the tapered side surface, it is possible to adjust the position in a continuous manner and it is possible to perform the fine adjustment.

The clamp adjustment mechanism comprises the screw 18, bracket 16, the plate 13 and the like. The clamp member includes the gripper 10 and the front abutment 17.

In the offset printing machine according to the present invention, it is possible to extremely readily adjust the image, printed on the print with a twist, in parallel with the plate cylinder shaft. It is therefore possible to enhance the working efficiency. Since the moving member having the tapered surface is used, it is possible to continuously perform the adjustment operation with a fine adjustment. Furthermore, the structure of the moving member and the clamp adjustment mechanism is simple and it is possible to enhance the adjustment precision of twist.

Also according to the reading method of the image position, two lines having any width are formed to thereby eliminate the error generated due to the configuration error of the register mark in case of use of the special register mark. Also, without using any apparatus or any jig for producing a register mark, it is possible to readily enter a mark for readout into the printing plate.

Since the readout of the line position is performed by reading out the opposite edges of the line and calculating its center as a line position, it is possible to detect the image position with high precision without adverse affect of a thin part of the line during the printing operation. Also, since the line position readout is based upon the readout from the edge of the print to the line, the line position readout is not affected by the print set position to the reading apparatus to thereby ensure the image position detection with high precision.

What is claimed is:

1. A method of registering a position of an image region on an image surface of a printing plate with respect to a plate cylinder in an offset printing machine in which said printing plate is automatically fed to said plate cylinder and is clamped at an end portion of the printing plate adjacent to said image region onto said plate cylinder by a clamping device which is swingable relative to a base side line of said plate cylinder, said method comprising the steps of:

drawing a first line, on the image surface at said end portion, which is in parallel with an outline of said image region adjacent to said end portion;

drawing a second line, on the image surface at said end portion, which is perpendicular to said first line and passes through a center of said image region;

detecting positions of said first and second lines and opposite lateral edges of said printing plate;

calculating an amount of displacement of the position of said image region relative to a standard position in rotational, lateral and twist directions of said plate cylinder, on the basis of a relationship between the detected positions of said first and second lines and said lateral edges; and adjusting the position of said image region in the twist direction by swinging said clamping device relative to the base side line of said plate cylinder in correspondence with the calculated amount of displacement in the twist direction.

2. A method according to claim 1, further comprising the step of adjusting the position of said image region in the rotational direction by rotating the plate cylinder in correspondence with the calculated amount of displacement in the rotational direction.

3. A method according to claim 1, further comprising the step of adjusting the position of said image region in the lateral direction by moving said plate cylinder in the lateral direction in correspondence with the calculated amount of displacement in the lateral direction.

4. A method according to claim 1, wherein before the step of drawing said first line, an original is printed onto said image surface, and said first line is drawn in parallel with an outline of one side of said original at said end portion.

5. A method according to claim 1, wherein, in the calculating step, the amount of displacement in the rotational direction is determined as a predetermined function of a distance between an edge of said printing plate at said end portion and a first point on said first line and a distance between said edge and a second point on said first line, which is separated from said first position by a predetermined distance.

6. A method according to claim 1, wherein, in the calculating step, the amount of displacement in the lateral direction is determined as a predetermined function of a width of said printing plate and a distance between a lateral edge thereof and a predetermined point on said second line.

7. A method according to claim 1, wherein, in the calculating step, the amount of displacement in the twist direction is determined as a predetermined function of a distance between an edge of said printing plate at said end portion and a first point on said first line, a distance between said edge of said printing plate and a second point on said first line, which is separated from said first point by a predetermined distance, a width of said printing plate and a distance between said first and second points.

* * * * *